US010053327B2

(12) United States Patent
Leslie et al.

(10) Patent No.: US 10,053,327 B2
(45) Date of Patent: Aug. 21, 2018

(54) ROTATING FAIRLEAD DEVICE

(71) Applicant: Wintech International, LLC, Bossier City, LA (US)

(72) Inventors: James C. Leslie, Bossier City, LA (US); James C. Santos, Bossier City, LA (US); Derek J. Leslie, Bossier City, LA (US)

(73) Assignee: Wintech International, LLC, Bossier City, LA (US)

( * ) Notice: Subject to any disclaimer, the term of this patent is extended or adjusted under 35 U.S.C. 154(b) by 0 days.

(21) Appl. No.: 15/281,454

(22) Filed: Sep. 30, 2016

(65) Prior Publication Data

US 2018/0093848 A1 Apr. 5, 2018

(51) Int. Cl.

| | |
|---|---|
| ***B66D 1/38*** | (2006.01) |
| ***B65H 57/14*** | (2006.01) |
| ***B63B 21/10*** | (2006.01) |
| ***B66D 1/36*** | (2006.01) |

(52) U.S. Cl.

CPC ..... *B65H 57/14* (2013.01); *B63B 21/10* (2013.01); *B66D 1/36* (2013.01); *B66D 1/38* (2013.01)

(58) Field of Classification Search

CPC ..... B65H 57/14; B65H 57/26; B66D 1/38; B66D 1/36; B63B 21/10; B63B 21/50

See application file for complete search history.

(56) References Cited

U.S. PATENT DOCUMENTS

| | | | | |
|---|---|---|---|---|
| 2,946,559 | A * | 7/1960 | Pickett | B65H 57/14 254/134.3 PA |
| 3,231,260 | A * | 1/1966 | Shirley | E05F 15/686 254/336 |
| 3,549,129 | A * | 12/1970 | Graham | B63B 21/56 114/245 |
| 3,809,334 | A * | 5/1974 | Beurer | B64D 1/22 242/390.2 |
| 4,015,798 | A * | 4/1977 | Benya | B66D 1/38 242/157.1 |

(Continued)

FOREIGN PATENT DOCUMENTS

| | | | | |
|---|---|---|---|---|
| GB | 959937 | A * | 6/1964 | B63B 21/10 |

OTHER PUBLICATIONS

Smith Berger Marine, Inc., Internet web page entitled "Deck Mounted Balanced Head Fairleads", at http://www.smithberger.com/fairleads.htm, unknown publication date.

*Primary Examiner* — Michael E Gallion
(74) *Attorney, Agent, or Firm* — Warner J. Delaune; Baker Donelson, et al.

(57) ABSTRACT

A rotating fairlead device is provided, comprising a base frame having a bearing support member, a slew bearing mounted to the bearing support member; and an exit sheave assembly mounted to the slew bearing, combined to form a single head fairlead. The single head fairlead may further include a plurality of guide rollers mounted to the base frame adjacent to the slew bearing. A dual head fairlead is also provided, wherein both entry and exit sheave assemblies are mounted on their respective slew bearings on opposite sides of the base frame. Optionally, a load sending device is disposed within the base frame between the opposing slew bearings to detect the load on a cable residing within the dual head fairlead.

11 Claims, 4 Drawing Sheets

(56) References Cited

U.S. PATENT DOCUMENTS

| | | | | | |
|---|---|---|---|---|---|
| 4,354,667 | A * | 10/1982 | Svendsen | A01K 73/12 | 254/332 |
| 4,492,363 | A * | 1/1985 | Niskin | B66D 3/06 | 254/275 |
| 4,547,857 | A * | 10/1985 | Alexander | B66D 1/525 | 212/308 |
| 4,760,992 | A * | 8/1988 | Peppel | B63B 21/16 | 242/155 R |
| 5,364,075 | A * | 11/1994 | Montgomery | B63B 21/10 | 114/230.25 |
| 5,845,893 | A * | 12/1998 | Groves | B63B 21/10 | 114/293 |
| 6,729,606 | B1 * | 5/2004 | Durin | B65H 57/14 | 242/615.2 |
| 7,240,633 | B2 * | 7/2007 | Barlow | B63B 21/04 | 114/200 |
| 9,003,994 | B2 * | 4/2015 | Leverette | B63B 21/00 | 114/199 |
| 9,567,039 | B2 * | 2/2017 | Busson | B63B 21/18 | |
| 9,748,746 | B1 * | 8/2017 | Jordan | H02G 1/08 | |
| 9,751,715 | B2 * | 9/2017 | Cooper | B65H 51/02 | |
| 2011/0260126 | A1 * | 10/2011 | Willis | B63B 27/08 | 254/283 |
| 2017/0088388 | A1 * | 3/2017 | Lillich | B65H 54/2827 | |

* cited by examiner

ROTATING FAIRLEAD DEVICE

CROSS-REFERENCE TO RELATED APPLICATIONS

Not applicable.

BACKGROUND OF THE INVENTION

1. Field of the Invention

This invention relates to fairlead devices used to guide a wire rope, synthetic rope, or cable from a load exerting device to the load through a range of angles or deflection, and more particularly to such devices which incorporate a load tension measuring device.

2. Description of Related Art

Wire rope, synthetic rope, or cable used in mooring or anchoring of vessels or platforms in marine applications is typically routed from a winch or load exerting device to an anchor or mooring point. As the vessel or floating platform moves about the anchor point, the angle of the rope or cable originating from the winches changes resulting in the need for a deflector sheave, fairleads or fixed openings. Currently devices such as deflector sheaves, snatch blocks, and swivel fairleads are used to accommodate such angle changes. For the purposes of this description, the word cable will be used with the understanding that such term may include cable, wire rope, synthetic rope, or any other equivalent components used in anchoring or mooring applications.

As will be further explained elsewhere herein, existing designs of swivel fairleads incorporate a sheave assembly which swivels within a fixed outer cylinder mounted on a base. The sheave assembly includes an inner cylinder that rotates within the outer cylinder on a pair of roller bearings located at each end of the outer cylinder. These prior art swivel fairleads allow the cable to enter through a fixed entry point opposite the sheave, pass through the inner cylinder, and then exit over the sheave. Such a design does not accommodate changes in the entry point angle from the winch or load exerting device without the installation of additional guide rollers mounted on the entry side of the fairlead. Load or tension measurement in the cable is required in many applications, and the prior devices do not incorporate any type of load measuring device between the entry and exit point of the fairlead. Moreover, the double-bearing housing does not enable use of an entry device swiveling about the same axis as part of a unitary design, or a load measuring device between the entry and exit points.

Accordingly, what is needed is an improved fairlead device for deflecting cables in anchoring and mooring applications which accommodates a range of entry and exit angles, and which can include a load measurement device within the fairlead assembly.

SUMMARY OF THE INVENTION

A single head rotating fairlead device is provided, comprising a base frame having a first bearing support member; a first slew bearing having an inner race and an outer race, wherein the outer race is mounted to the first bearing support member; and a first sheave assembly mounted to the inner race of the first slew bearing.

The single head fairlead device may further comprise a plurality of guide rollers operatively mounted to the base frame adjacent to the slew bearing. In a more preferred embodiment, the guide rollers include a pair of vertical guide rollers and a horizontal guide roller.

In another embodiment, the first sheave assembly includes a first sheave, and wherein the first sheave includes a cable resting portion in alignment with a central axis of the first slew bearing.

In another embodiment, a dual head fairlead device is provided, comprising a base frame having a first bearing support member; a first slew bearing having an inner race and an outer race, wherein the outer race is mounted to the first bearing support member; and a first sheave assembly mounted to the inner race of the first slew bearing; and further including a second bearing support member extending from the base frame; a second slew bearing having an inner race and an outer race, wherein the outer race is mounted to the second bearing support member; and a second sheave assembly mounted to the inner race of the second slew bearing.

In another embodiment of the dual head fairlead device, the first sheave assembly is adapted to receive entry of a cable into the fairlead device, and the second sheave assembly is adapted to allow exit of a cable from the fairlead device.

In a more preferred embodiment, the central axis of the first slew bearing and the central axis of the second slew bearing are collinear.

In a more preferred embodiment, a load sensing device is mounted to the base frame and operatively disposed between the first slew bearing and the second slew bearing, and the load sensing device is a strain gauge pin operatively attached to a load deflection sheave.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1B:
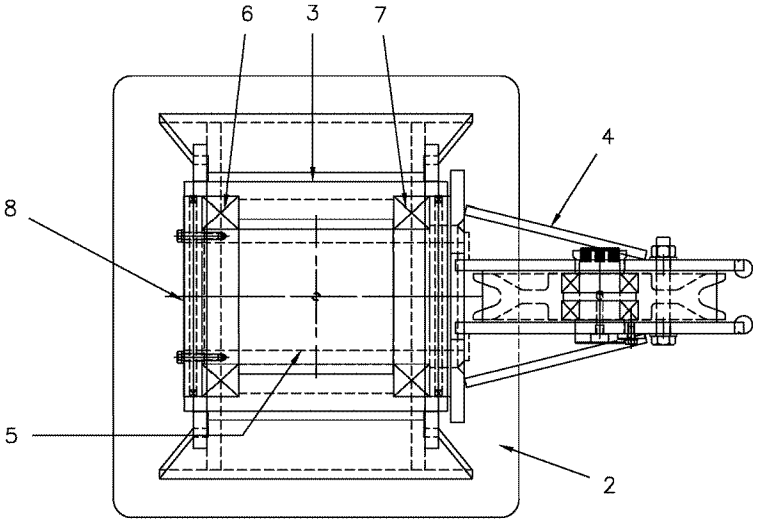
FIG. 1B (PRIOR ART)
FIGS. 1A and 1B illustrate a prior art fairlead which employs a pair of roller bearings within a fixed cylinder to enable swivel capability.
Figure 1A:
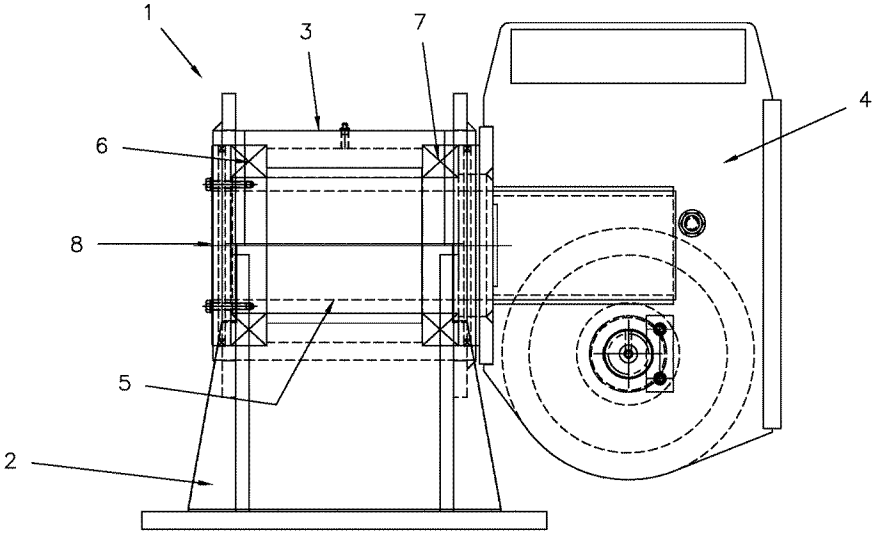
FIG. 1A (PRIOR ART)

In order to appreciate the novel aspects of the present invention, a typical prior art fairlead device will first be described with reference to FIGS. 1A and 1B, both labeled as prior art. As stated earlier herein, existing designs of swivel fairleads 1 generally comprise a base 2 that is mountable to a deck or other structure, an outer cylinder 3 affixed to the base 2, and a sheave assembly 4 having an inner cylinder 5 which swivels within the outer cylinder 3. The inner cylinder 5 of the sheave assembly 4 rotates within the outer cylinder 3 on a pair of roller bearings 6, 7 which are installed inside each end of the outer cylinder 3. Thus, a cable from a winch can enter the fairlead 1 through an entry point 8 opposite the sheave assembly 4, pass through the inner cylinder 5, and then exit over the sheave assembly 4 to an anchor or mooring location. One of the disadvantages in such a design is that the cable entry direction into the fairlead 1 must be aligned with or parallel to the axis of the inner cylinder 5, meaning that there are constraints on where and how the fairlead 1 is mounted to the deck. Another disadvantage is that the double-bearing design makes it mechanically impossible add an entry sheave opposite the exit sheave assembly 4 to accommodate variances in cable entry angle. For the above reasons, an improved fairlead design was required as described below.

Figure 2B:
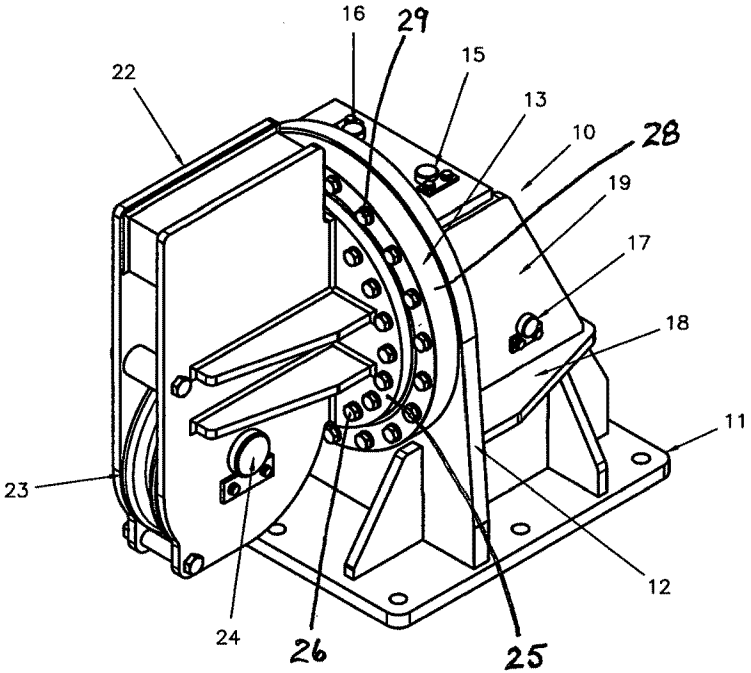
FIGS. 2A and 2B illustrate side and perspective views of a single head rotating fairlead of present invention employing a slew bearing to enable swivel capability at the cable exit.
Figure 2A:
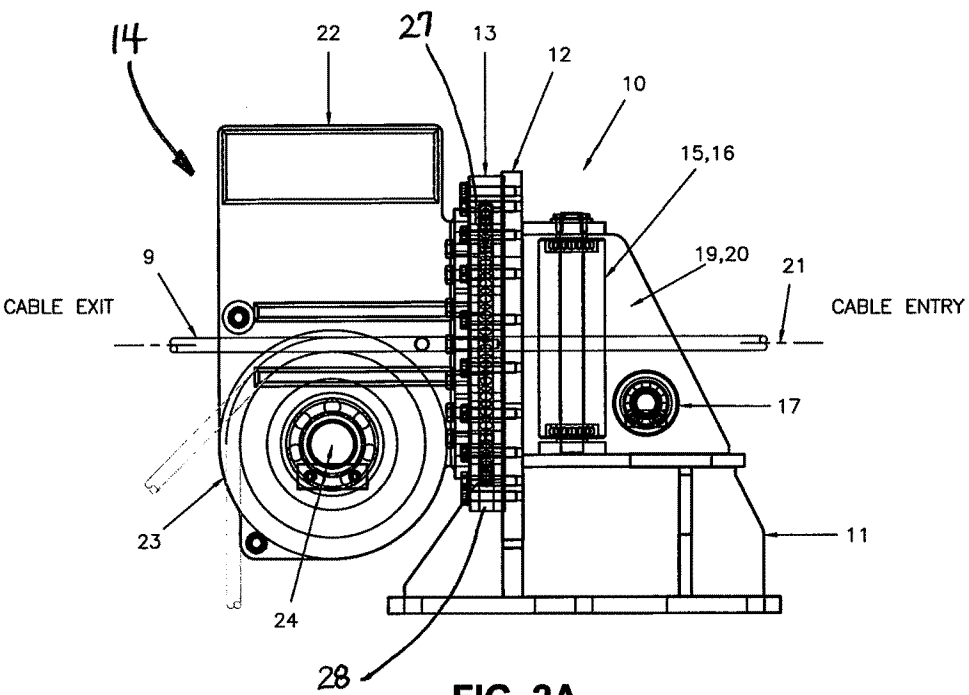

Therefore, a preferred embodiment of an improved rotating fairlead 10 is shown in FIGS. 2A and 2B, generally comprising a base frame 11 having a bearing support member 12, a single slew bearing 13 mounted to the bearing support member 12, and a sheave assembly 14 mounted to the slew bearing 13. The bearing support member 12 includes an opening approximately the same size as the central opening of the slew bearing 13. In this design, a cable 9 enters the fairlead 10 from behind the slew bearing 13 and through its central opening, and exits the fairlead 10 over the sheave assembly 14.

The base frame 11 may optionally include a pair of vertical guide rollers 15, 16, and a horizontal guide roller 17 positioned behind the slew bearing 13. Guide rollers 15, 16, 17 are rotatably attached between roller support members 18, 19, 20, and they ensure that the cable 9 remains relatively aligned with the central axis 21 of the slew bearing 13, despite variances due to vibration and other forces during operation.

The sheave assembly 14 is similar in many respects to prior art designs, comprising a sheave support frame 22 containing a sheave 23 mounted on a shaft 24. In most cases, the sheave 23 will be mounted such that when a cable 9 is passed through the fairlead 10, the cable 9 will rest on the sheave 23 in a cable resting portion in alignment with the central axis 21 of the slew bearing 13, as shown in FIG. 2A. However, the sheave support frame 22 further includes a mounting flange 25 attached via a plurality of sheave support bolts 26 to an inner race 27 of the slew bearing 13. The outer race 28 of the slew bearing 13 is attached via a plurality of bearing bolts 29 to the bearing support member 12.

As will be appreciated, the mechanical arrangement of the slew bearing 13 mounted to the base frame 11 allows the cable 9 to enter the back side of the slew bearing 13 and exit at any acute angle through 360 degrees over the sheave 23. The free rotation of the slew bearing 13 in conjunction with the load imposed by the cable 9 on the rotating sheave 23 automatically aligns the cable 9 with the direction of the load, as occurs with a moving vessel during an anchoring or mooring operation. Also, use of a slew bearing 13 eliminates the requirement for the outer cylinder 3, inner cylinder 5, and roller bearings 6, 7 in the prior art design of FIGS. 1A and 1B. A resultant advantage is the ability to have a unitary fairlead 10 assembly having guide rollers 15, 16, 17 immediately behind the slew bearing 13 in a compact and mechanically efficient design.

Figure 3B:
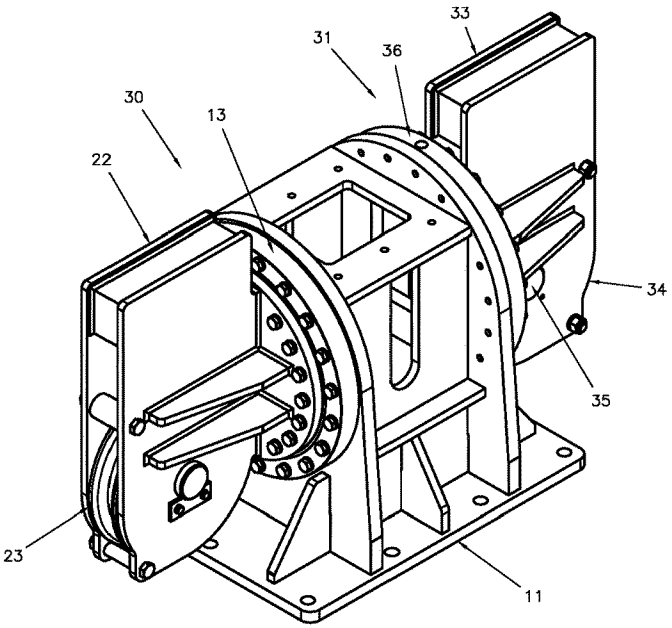
FIGS. 3A and 3B illustrate side and perspective views of a dual head rotating fairlead employing slew bearings to enable swivel capability at the cable entry and cable exit.
Figure 3A:
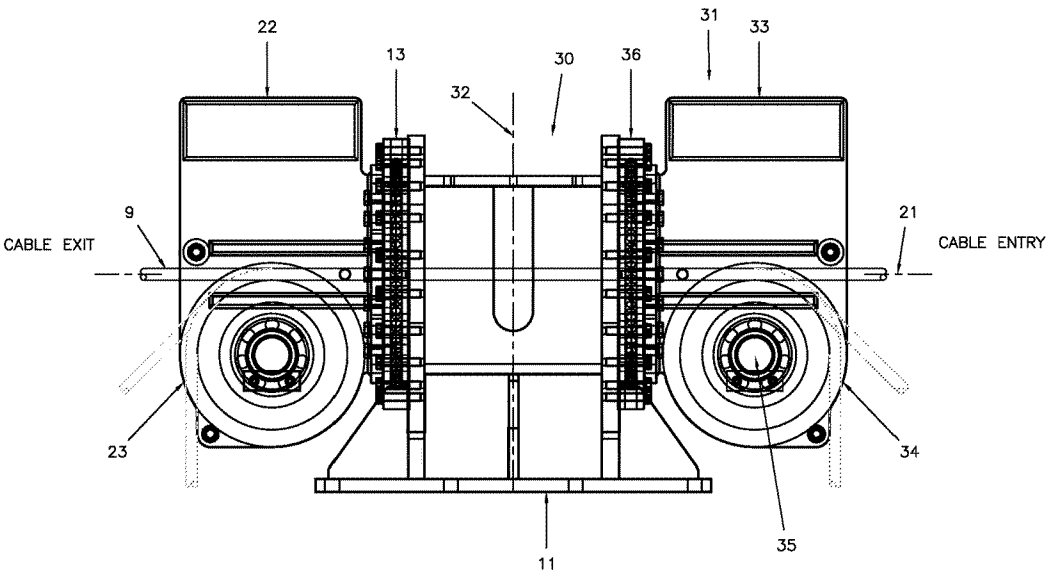

Turning now to FIGS. 3A and 3B, an alternate embodiment is illustrated in the form of a dual head fairlead 30. The dual head fairlead 30 is similar in many respects to the single head fairlead 10 of FIGS. 2A and 2B, but wherein the functionality of the guide rollers 15, 16, 17 is replaced by a symmetrically positioned entry fairlead assembly 31. In this design, the base frame 11 includes a vertical axis 32, such that all components and features on each side of the vertical axis 32 are symmetrically similar. For example, the entry fairlead assembly 31 comprises a sheave support frame 33 containing a sheave 34 mounted on a shaft 35, and is mounted to its own slew bearing 36 in the same manner as described above. While this specific embodiment depicts a preferred design that reflects symmetry, symmetry with respect to component sizes and exact placement are not required in order to achieve most, if not all, of the advantages of the present invention. Likewise, this embodiment depicts the central axes 21 of both slew bearings 13, 36 as being collinear or identical, but such condition is not necessarily required.

In addition to the features and advantages described with respect to the single head fairlead 10, the addition of an entry fairlead assembly 31 allows cable 9 to enter the fairlead 30 from any acute angle through 360 degrees. Thus, the dual head fairlead 30 will accommodate a wide range of cable 9 entry and exit orientations.

Figure 4B:
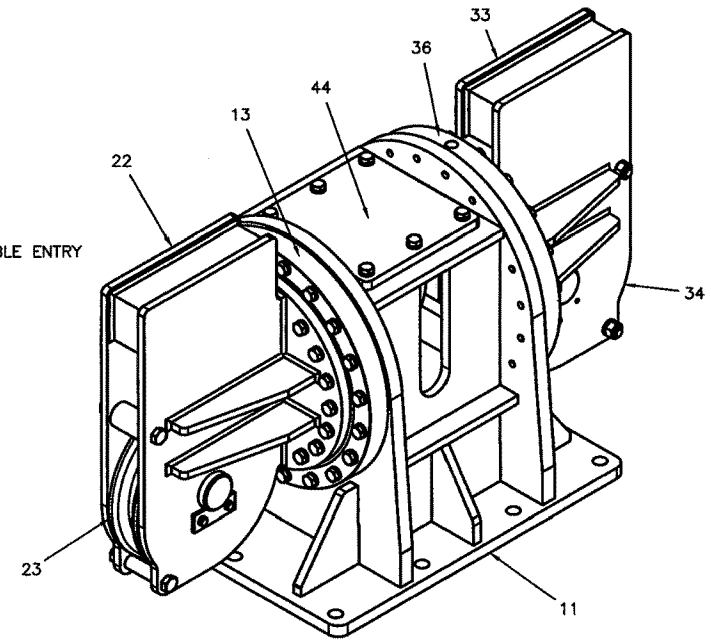
FIGS. 4A and 4B illustrate side and perspective views of the dual head fairlead of FIGS. 3A and 3B, further including a load deflection and measuring device.
Figure 4A:
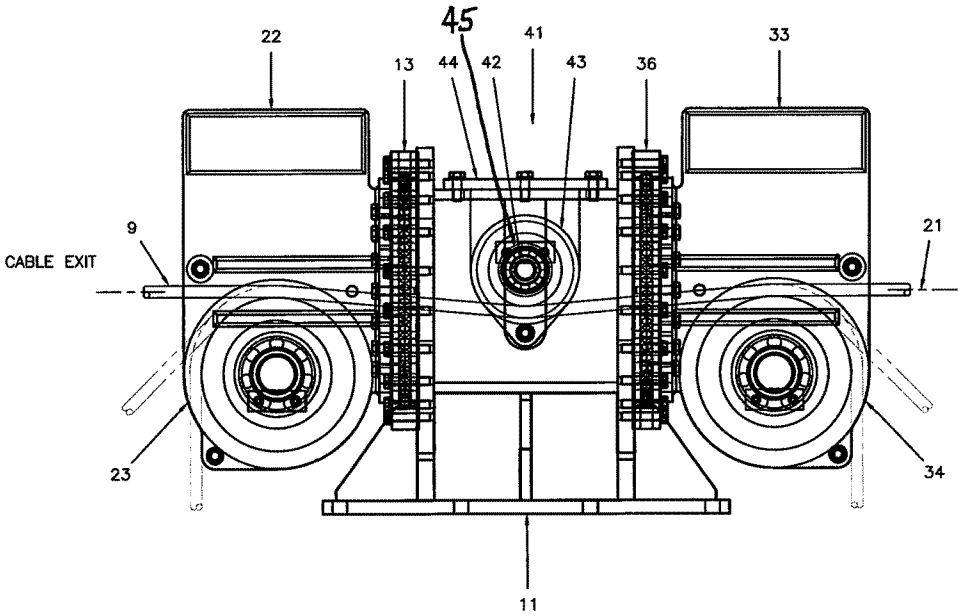

With reference to FIGS. 4A and 4B, a further embodiment of the present invention is illustrated in the form of a load sensing fairlead 40. The fairlead 40 is identical in most respects to the fairlead 30 of FIGS. 3A and 3B, but with the addition of a load sensing assembly 41 disposed between the two slew bearings 13, 36. In this design, the load sensing assembly 41 comprises a load sensing device 42 and a load deflection sheave 43 which are operatively affixed to a load sensing mount 44. For example, the load deflection sheave 43 may be mounted on a strain gauge pin 45 selected to detect the forces acting upon the cable 9. The load sensing assembly 41 is mounted to the base frame 11 such that when a cable 9 resides within the fairlead 40, as shown in FIG. 4A, the load sensing device 42 measures the load on the cable 9 regardless of the direction of entry or exit from the fairlead 40. Thus, the entry and exit fairlead sheaves 23, 34 are aligned with the centerline of the slew bearings 13, 36, and the cable 9 resides across the load deflection sheave 43. The alignment of the pivoting sheaves 23, 34 about the slew bearing central axes ensures that the alignment of the cable 9 remains constant over the load deflection sheave 43. The load measurement of the cable 9 tension remains constant regardless of entry or exit angle around the entry and exit sheaves 23, 34.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A rotating fairlead device, comprising:

a base frame having a first bearing support member;

a first single slew bearing having an inner race and an outer race, wherein the outer race is mounted to the first bearing support member by a plurality of bearing bolts; and a first sheave assembly mounted to the inner race of the first single slew bearing by a plurality of sheave support bolts.

2. The device of claim 1, further comprising a plurality of cable guide rollers operatively mounted to the base frame adjacent to the single slew bearing.

3. The device of claim 2, wherein the cable guide rollers include a pair of vertical cable guide rollers and a horizontal cable guide roller.

4. The device of claim 1, wherein the first sheave assembly includes a first sheave, and wherein the first sheave includes a cable resting portion in alignment with a central axis of the first single slew bearing.

5. The device of claim 1, further including:

a second bearing support member extending from the base frame;

a second single slew bearing having an inner race and an outer race, wherein the outer race is mounted to the second bearing support member by a plurality of bearing bolts; and a second sheave assembly mounted to the inner race of the second single slew bearing by a plurality of sheave support bolts.

6. The device of claim 5, wherein the second sheave assembly includes a second sheave, and wherein the second sheave includes a cable resting portion in alignment with a central axis of the second single slew bearing.

7. The device of claim 5, wherein the first sheave assembly is adapted to receive entry of a cable into the fairlead device, and wherein the second sheave assembly is adapted to allow exit of a cable from the fairlead device.

8. The device of claim 5, wherein the central axis of the first single slew bearing and the central axis of the second single slew bearing are collinear.

9. The device of claim 5, further including a load sensing device mounted to the base frame and operatively disposed between the first single slew bearing and the second single slew bearing.

10. The device of claim 9, wherein the load sensing device is operatively attached to a load deflection sheave.

11. The device of claim 10, wherein the load sensing device is a strain gauge pin.

* * * * *